US005173711A

United States Patent [19]

Takeuchi et al.

[11] Patent Number: 5,173,711

[45] Date of Patent: Dec. 22, 1992

[54] MICROSTRIP ANTENNA FOR TWO-FREQUENCY SEPARATE-FEEDING TYPE FOR CIRCULARLY POLARIZED WAVES

[75] Inventors: Kazunori Takeuchi, Ichigayata; Masayuki Yasunaga, Tokyo; Takayasu Shiokawa, Nukuiminami, all of Japan

[73] Assignee: Kokusai Denshin Denwa Kabushiki Kaisha, Tokyo, Japan

[21] Appl. No.: 906,030

[22] Filed: Jun. 26, 1992

Related U.S. Application Data

[63] Continuation of Ser. No. 617,350, Nov. 23, 1990, abandoned.

[30] Foreign Application Priority Data

Nov. 27, 1989 [JP] Japan ..... 1-307258

[51] Int. Cl.[5] ..... H01Q 1/38

[52] U.S. Cl. ..... 343/700 MS; 343/846

[58] Field of Search ..... 343/700 MS, 713, 829, 343/828, 846, 711

[56] References Cited

U.S. PATENT DOCUMENTS 4,101,895 7/1978 Jones, Jr. ..... 343/700 MS
4,700,194 10/1987 Ogawa et al. ..... 343/700 MS

FOREIGN PATENT DOCUMENTS 2067842 7/1981 United Kingdom ..... 343/700 MS
2147744 5/1985 United Kingdom ..... 343/700 MS
2198290 6/1988 United Kingdom .

OTHER PUBLICATIONS

Sanford, "Recent Developments in the Design of Conformal Microstrip Phased Arrays", IEEE Conf., No. 160, Mar. 7-9, 1978, pp. 105-108.

*Primary Examiner*—Rolf Hille
*Assistant Examiner*—Hoanganh Le
*Attorney, Agent, or Firm*—Emmanuel J. Lobato; Robert E. Burns

[57] ABSTRACT

A microstrip antenna of two-frequency separate-feeding type for circularly polarized waves is disclosed, in which four radiation conductors are disposed on a dielectric plate mounted on a conducting ground plane and each radiation conductor has its marginal portion partly short-circuited via a short-circuiting conductor to the conducting ground plane and is supplied at its feeding point with power via a feeder passing through the conducting ground plane and the dielectric plate. The four radiation conductors are composed of two pairs of radiation conductors of different sizes adjusted so that two desired frequencies can simultaneously be used for transmission and for reception, respectively, the conductors of each pair being arranged to generate a circularly polarized wave.

7 Claims, 9 Drawing Sheets

MICROSTRIP ANTENNA FOR TWO-FREQUENCY SEPARATE-FEEDING TYPE FOR CIRCULARLY POLARIZED WAVES

This is a continuation of application Ser. No. 07/617,350, filed Nov. 23, 1990 now abandoned.

BACKGROUND OF THE INVENTION

The present invention relates to a microstrip antenna of two-frequency separate-feeding type for circularly polarized waves which is employed for various radio communications.

A microstrip antenna is of wide application as an antenna for various communications, because it has a planar structure of a thickness sufficiently small as compared with the wavelength used and is lightweight. With a phased array antenna using a plurality of such microstrip antennas it is possible to electrically change a beam of radio wave by controlling the phase shift amount of a phase shifter connected to each antenna element. Such a phased array antenna features its thin, small and lightweight structure, and hence is expected to be applied to mobile communication and the like.

As is well-known in the art, the microstrip antenna is narrow-band. For example, assuming that a voltage standing wave ratio of the antenna, i.e. a criterion upon which to determine whether or not the antenna can be put to practical use, is 2 or below, the bandwidth of the microstrip antenna which satisfies the ratio is as small as several percents with respect to the center frequency, though it depends on the characteristic of a dielectric plate used. This means that an ordinary microstrip antenna cannot be used for communications in which transmit and receive radio waves higher than such a bandwidth as mentioned above. To solve this problem, microstrip antennas of various structures have been proposed so far.

However, conventional art has defects such as complicated structure and difficulty in fabrication.

SUMMARY OF THE INVENTION

Therefore, an object of the present invention is to provide a microstrip antenna of two-frequency separate-feeding type for circularly polarized waves which is small in size and easy to manufacture.

With a view to solving the above-noted problems, the microstrip antenna of the present invention features a structure in which four radiation conductors are disposed on a dielectric plate mounted on a conducting ground plane and each radiation conductor has its marginal portion partly short-circuited via a short-circuiting conductor to the conducting ground plane and is supplied at its feeding point with power via a feeder passing through the conducting ground plane and the dielectric plate, and in which the four radiation conductors are composed of two pairs of radiation conductors of different sizes adjusted so that two desired frequencies can simultaneously be used for transmission and for reception, respectively, the conductors of each pair being arranged to generate a circularly polarized wave.

BRIEF DESCRIPTION OF THE DRAWINGS

The present invention will be described in detail below in comparison with prior art with reference to accompanying drawings, in which.

DETAILED DESCRIPTION

To make differences between prior art and the present invention clear, examples of prior art will first be described.

Figure 5A:
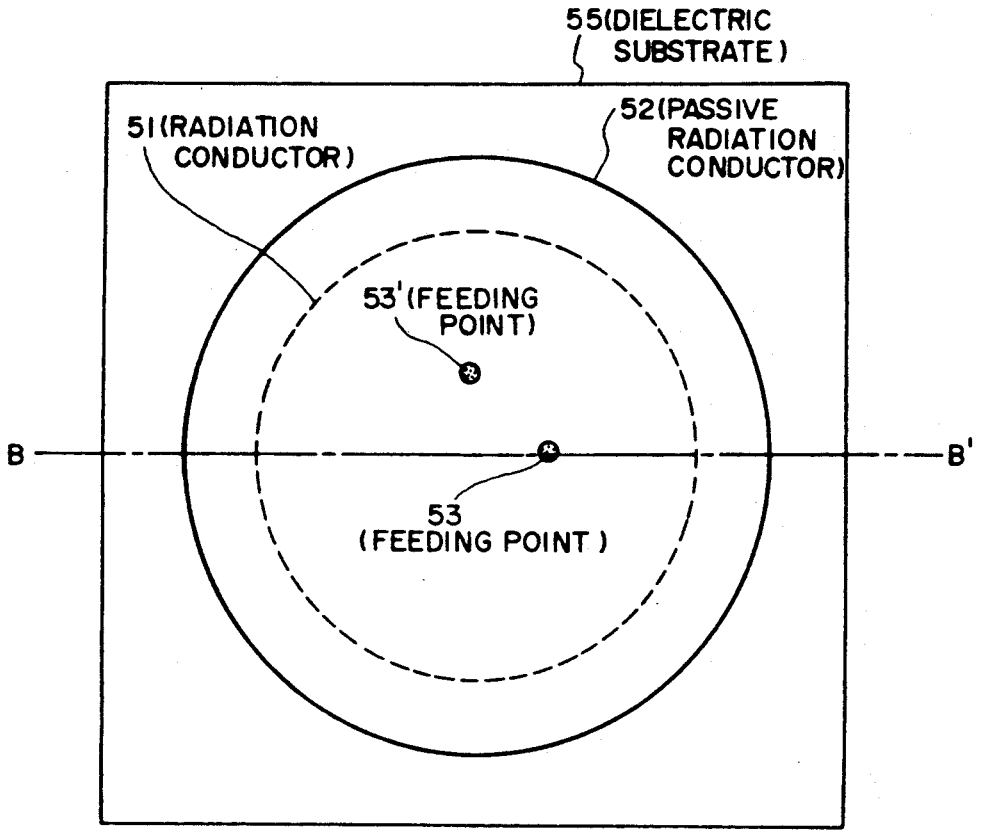
Fig. 5A PRIOR ART
FIGS. 5A and 5B are a plan view and a sectional view taken on the line B—B′ illustrating a conventional microstrip antenna for circularly polarized waves designed for wide-band use.
Figure 5B:
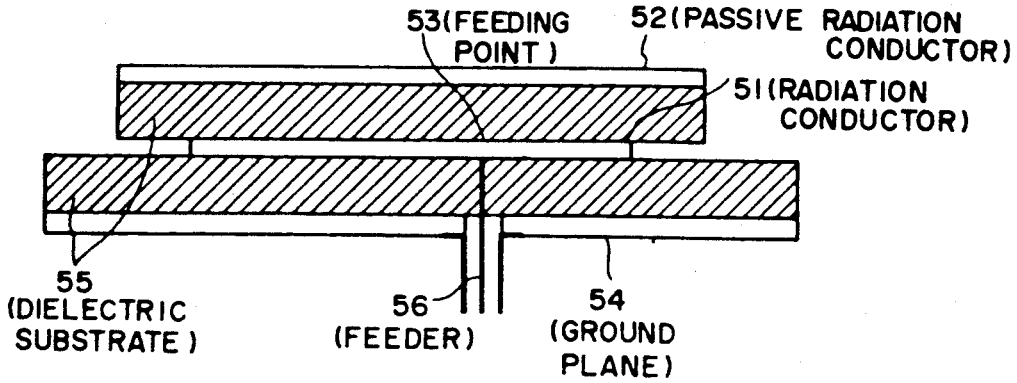
Fig. 5B PRIOR ART

FIGS. 5A and 5B show in combination an examples of the structure of a conventional microstrip antenna intended for enhanced bandwidth, FIG. 5A being a plan view and FIG. 5B a sectional view taken on the line B—B′ in FIG. 5A. Reference numeral 51 indicates a radiation conductor, 52 a passive radiation conductor, 53 and 53′ feeding points, 54 a grounded conductor, 55 dielectric substrate, and 56 a feeder. The feeding point 53 is connected to the feeder 56 feeding via a connector provided on the grounded conductor 54. With the structure of this example, an antenna which resonates in the transmitting or receiving frequency band can be obtained by adjustment of the sizes of the radiation conductor 51 and the passive radiation conductor 52.

Figure 8:
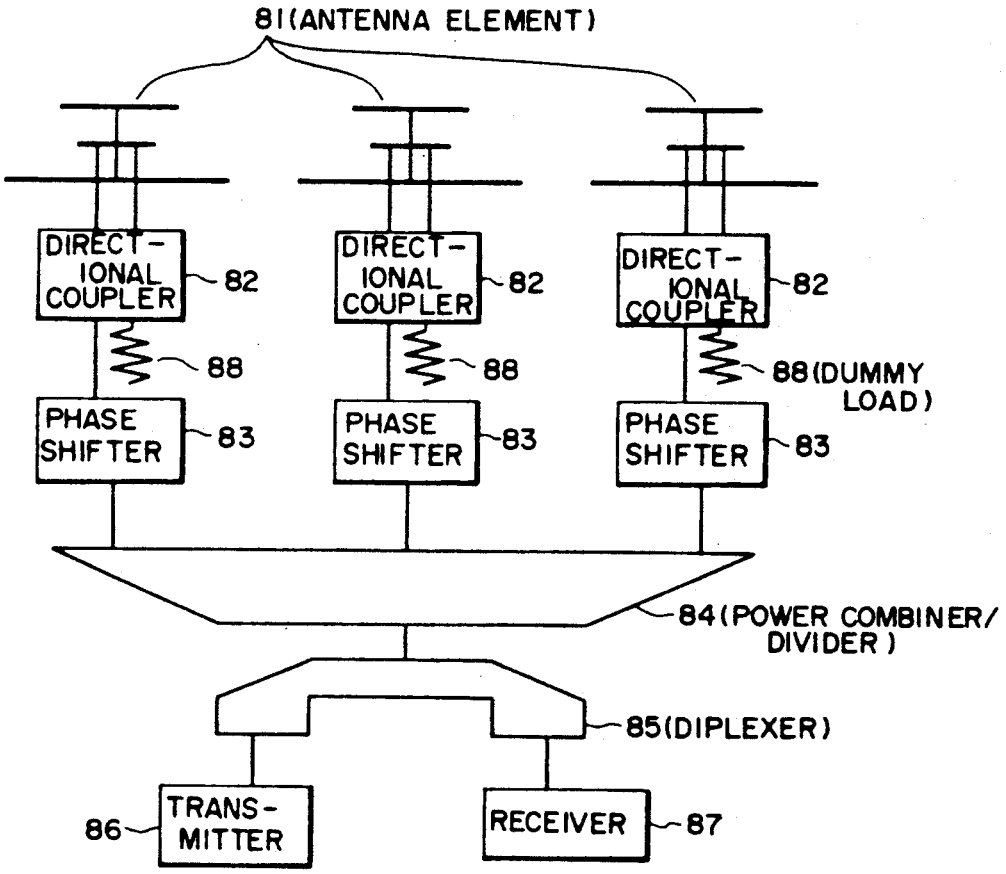
Fig. 8 PRIOR ART
FIG. 8 is a block diagram showing a phased array antenna employing the conventional wide-band microstrip antenna for circularly polarized waves depicted in FIG. 3.

FIG. 8 is block diagram showing a conventional phased array antenna using microstrip antennas exemplified in FIG. 5. Reference numeral 81 indicates each antenna element, 82 a directional coupler for generating a circularly polarized wave, 83 a phase shifter, 84 a power divider, 85 a diplexer, 86 a transmitter, 87 a receiver, and 88 a dummy load. By changing the phase of a feed signal by the phase shifter 83 for each antenna element 81, the direction of the beam can be controlled electrically.

Figure 6A:
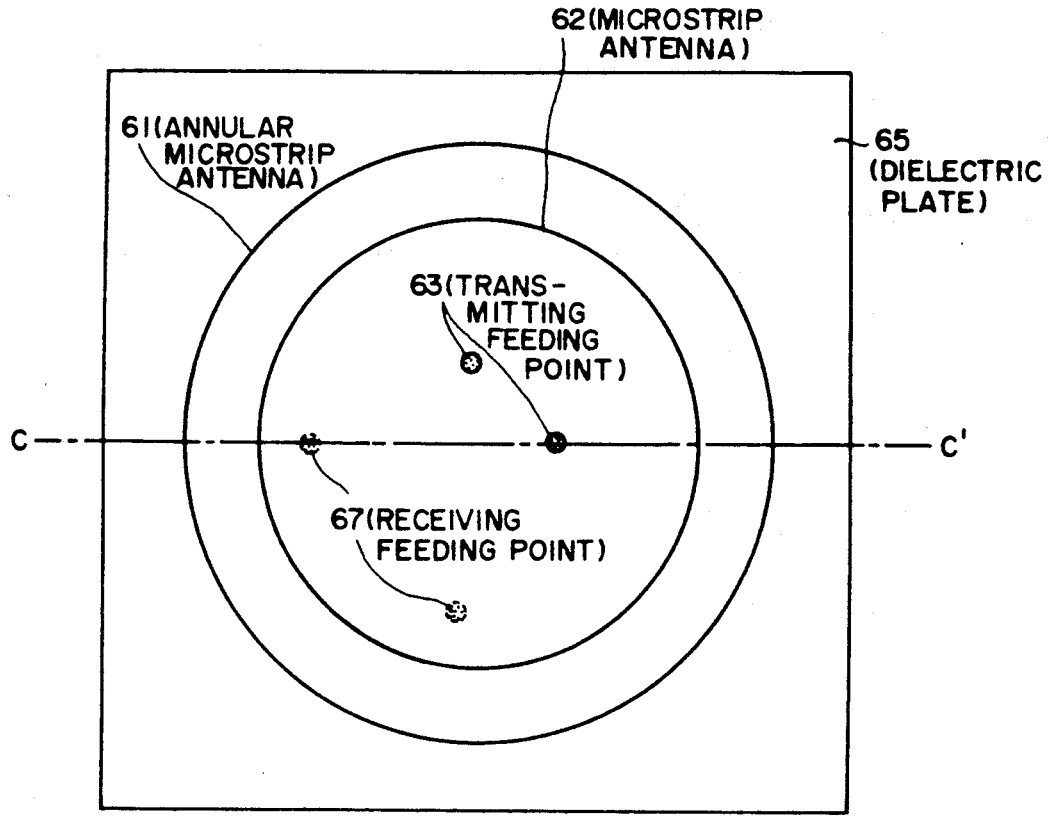
Fig. 6A PRIOR ART
FIGS. 6A and 6B are a plan view and a sectional view taken on the line C—C′ for illustrating a conventional microstrip antenna of two-frequency separate feeding type for circularly polarized waves.
Figure 6B:
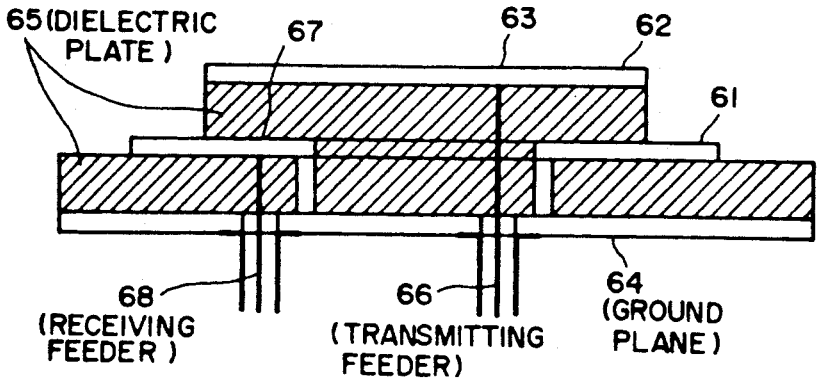
Fig. 6B PRIOR ART

FIGS. 6A and 6B show in combination another example of the conventional antenna structure which is simultaneously operable for transmission and for reception, FIG. 6A being its plan view and FIG. 6B its sectional view taken on the line C—C′ in FIG. 6A. Reference numeral 61 indicates an annular microstrip antenna (a radiation conductor for reception), and 62 a circular microstrip antenna (a radiation conductor for transmission). These antennas are fed from their back sides independently of each other through a transmitting feeder 66 and a receiving feeder 68 to a transmitting feeding point 63 and a receiving feeding point 63, respectively. With this structure, the annular microstrip antenna 61 and the microstrip antenna 62 resonate in receive and transmit frequency bands, respectively. In this example, reference numeral 64 is a conducting ground plane, and 65 a dielectric substrate.

Figure 7A:
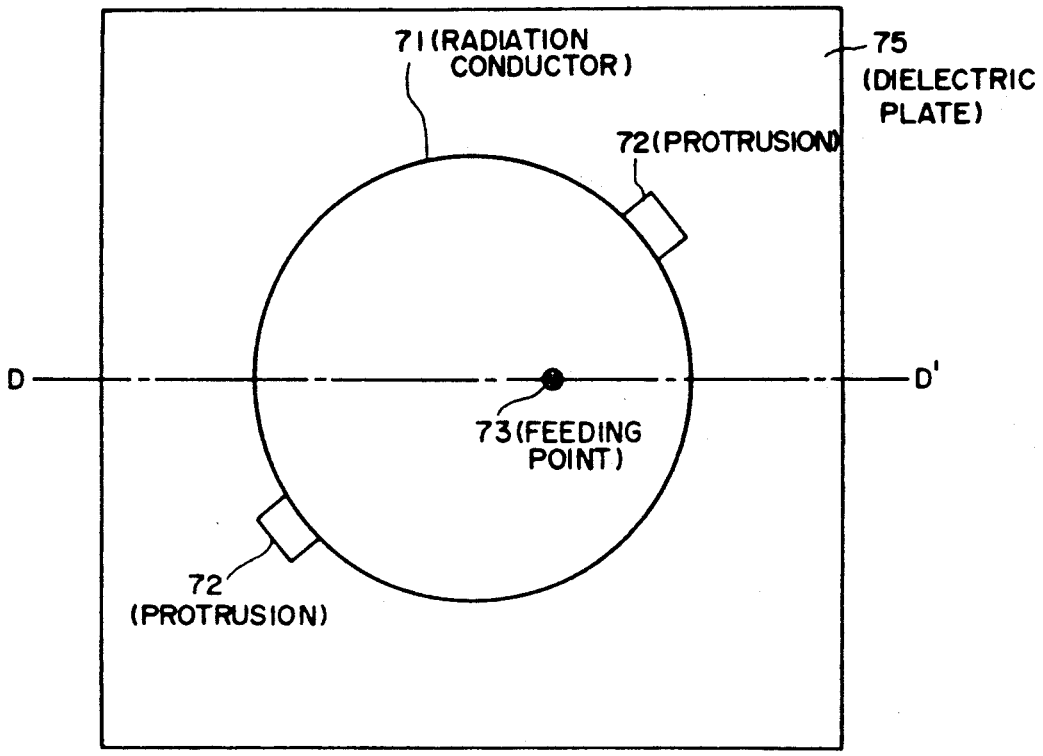
Fig. 7A PRIOR ART
FIGS. 7A and 7B are a plan view and a sectional view taken on the line D—D′, showing a conventional one-point feeding type microstrip antenna for circularly polarized waves.
Figure 7B:
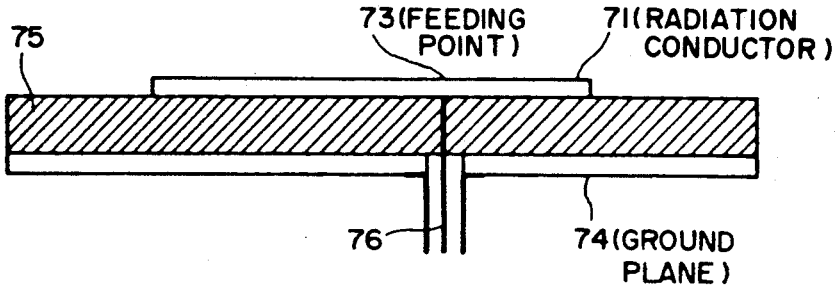
Fig. 7B PRIOR ART

The antenna for circularly polarized waves usually employed in mobile communication can be implemented by feeding at two points as mentioned above in connection with FIGS. 5A, 5B and 6A, 6B, and there has also been well known a circular polarized antenna of one-point feeding which has only one feeding point as shown in FIGS. 7A and 7B. In FIGS. 7A and 7B the function of an antenna for circularly polarized waves which has only one feeding point 73 is obtainable by the additional provision of protrusions 72 on a radiation conductor 71. In this example, reference numeral 74 is a conducting ground plane, 75 a dielectric plate, and 76 a feeder.

In case of constructing a phased array antenna through use of the above-described prior art, the wide-band microstrip antenna or dual-frequency resonance type microstrip antenna shown in FIGS. 5A and 5B poses a problem as they are complex in design and construction.

In addition, since the feeding portion is common to transmission and reception and the phased of transmission and reception are controlled by the same phase shifter 83 as shown in FIG. 8, the prior art possesses a shortcoming that transmission and received beams do not correspond to each other owing to a difference in frequency therebetween, and the diplexer 85 which must be provided between the phase shifters 83 and the transmitter 86 and the receiver 87 for separating transmission and received signals makes the feeding portion bulky. Reference numeral 81 indicates antenna elements, 82 directional couplers, 84 a power combiner/divider, 85 a diplexer, and 88 a dummy load.

The antenna structure having an annular microstrip antenna and a circular microstrip antenna disposed thereon, shown in FIGS. 6A and 6B, does not call for a diplexer or circulator, because a feeding point for transmission 63 and a receiving feeding point 67 are sufficiently isolated from each other electrically. However, this antenna structure is two-layer and hence is more complex in construction and heavier than an antenna of a one-layer structure, and the manufacture of this antenna involves many steps and requires high machining accuracy.

The circular polarized antenna of one-point feeding depicted in FIGS. 7A and 7B is not suitable as an antenna for wide-band communications, because it is narrow-band rather than the usual microstrip antenna and has frequency dependence of its axial ratio.

The present invention is intended to solve the above-mentioned problems of the prior art and therefore to provide a microstrip antenna of two-frequency separate feeding type which is small in size and easy to manufacture.

The present invention will now be described.

EMBODIMENT 1

Figure 1A:
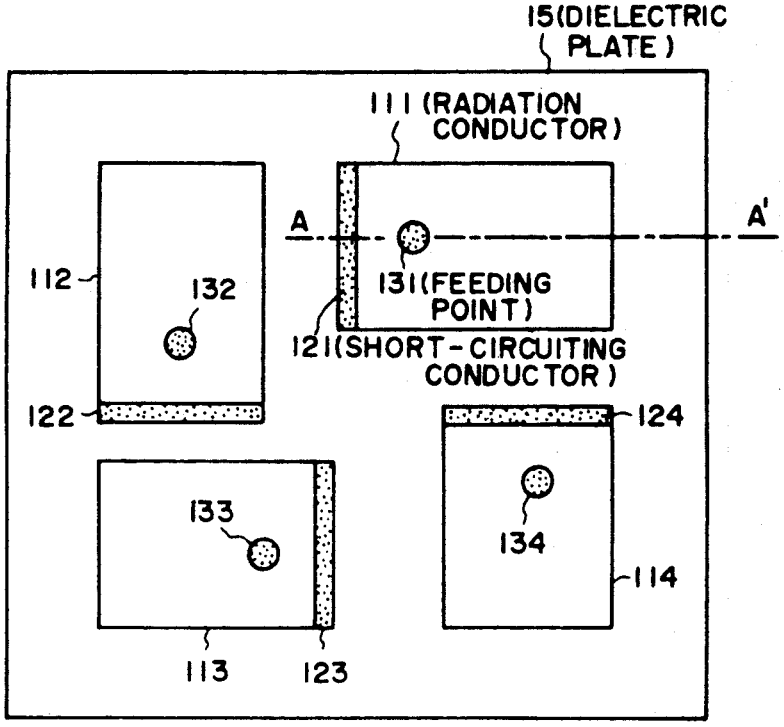
FIGS. 1A and 1B are a plan view and a sectional view taken on the line A—A′ therein, both illustrating an embodiment of the present invention.
Figure 1B:
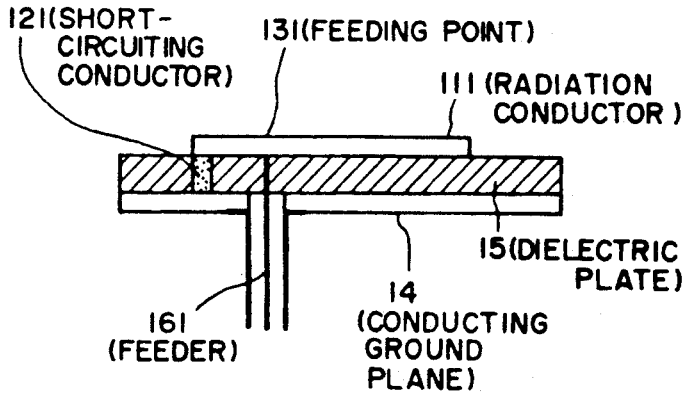

FIGS. 1A and 1B illustrate in combination a first embodiment of the present invention as being applied to a microstrip antenna in which one side of each radiation conductor is short-circuited. FIG. 1A is a plan view of the antenna and FIG. 1B a sectional view taken on the line A—A' in FIG. 1A. As shown, four radiation conductors 111 through 114 are disposed on a dielectric plate 15 and are short-circuited to a conducting ground plane 14 via short-circuiting conductors 121 through 124, respectively. Reference numerals 131 to 134 denote feeding points of the radiation conductors 111 to 114, respectively, which are fed with power from its back side through feeders (a feeder 161 at a feeding point 131). The radiation conductors 111 and 112 are of the same size and have the same resonance frequency tuned to a frequency of a transmitting wave, whereas the radiation conductors 113 and 114 are of the same size and have the same resonance frequency tuned to a frequency of a receiving wave. Consequently, the radiation conductors 111 and 113 are different in size.

As regards transmission, signals fed in phase to the radiation conductors 111 and 112 are thereby rendered into a circularly polarized wave, which must be formed within the half wavelength of the frequency used, as is well-known in the art. The same is true of reception, because of reversibility of the antenna and the receiving antenna is formed by the radiation conductors 113 and 114 for receiving the circularly polarized wave. The radiation conductors 111, 112 for transmission and the radiation conductors 113, 114 for reception are disposed in such a manner as not to interfere with each other. To meet with these requirements, the radiation conductors 111, 112, 113 and 114 are disposed as shown in FIG. 1, and for each radiation conductor, a plane passing through its feeding point and perpendicular to the corresponding short-circuiting conductor (a plane A—A' for the conductor 111, for instance) forms a rectangle or square on the dielectric plate 15.

Figure 4A:
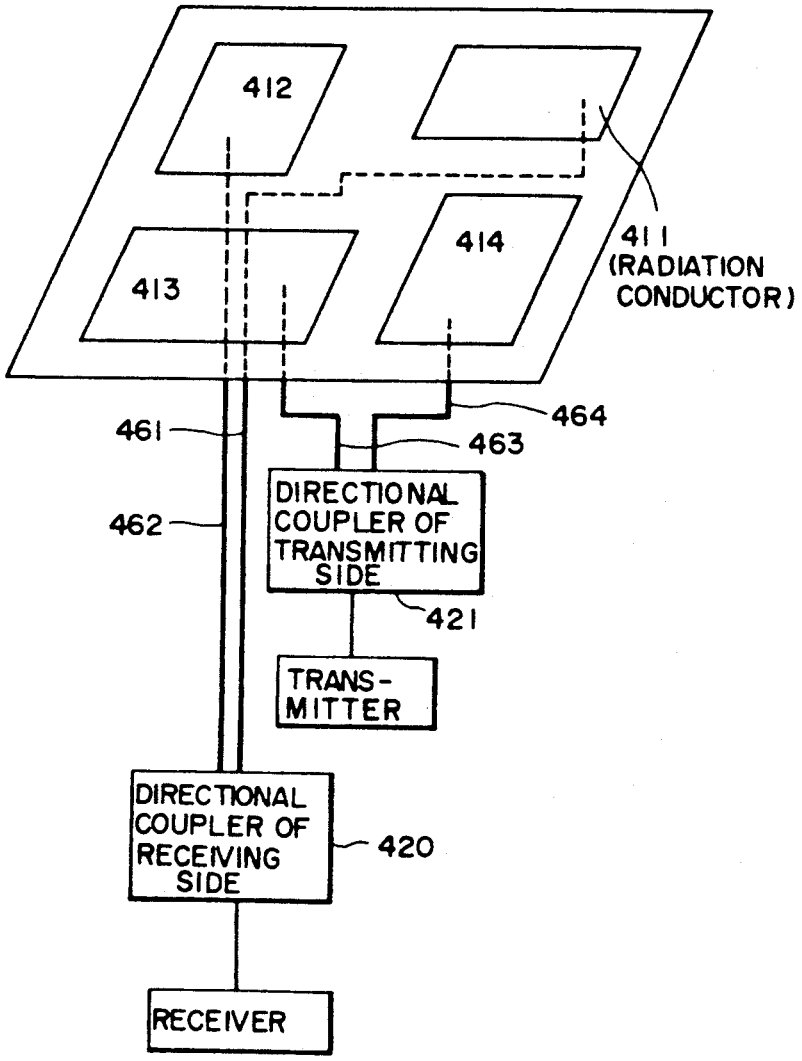
FIG. 4A is a block diagram showing transmitting-receiving equipment in which a transmitting device and a receiving device are connected to the microstrip antenna of two-frequency separate-feeding type for circularly polarized waves according to the present, shown in FIGS. 1, 2, 3A, or 3B.
Figure 4B:
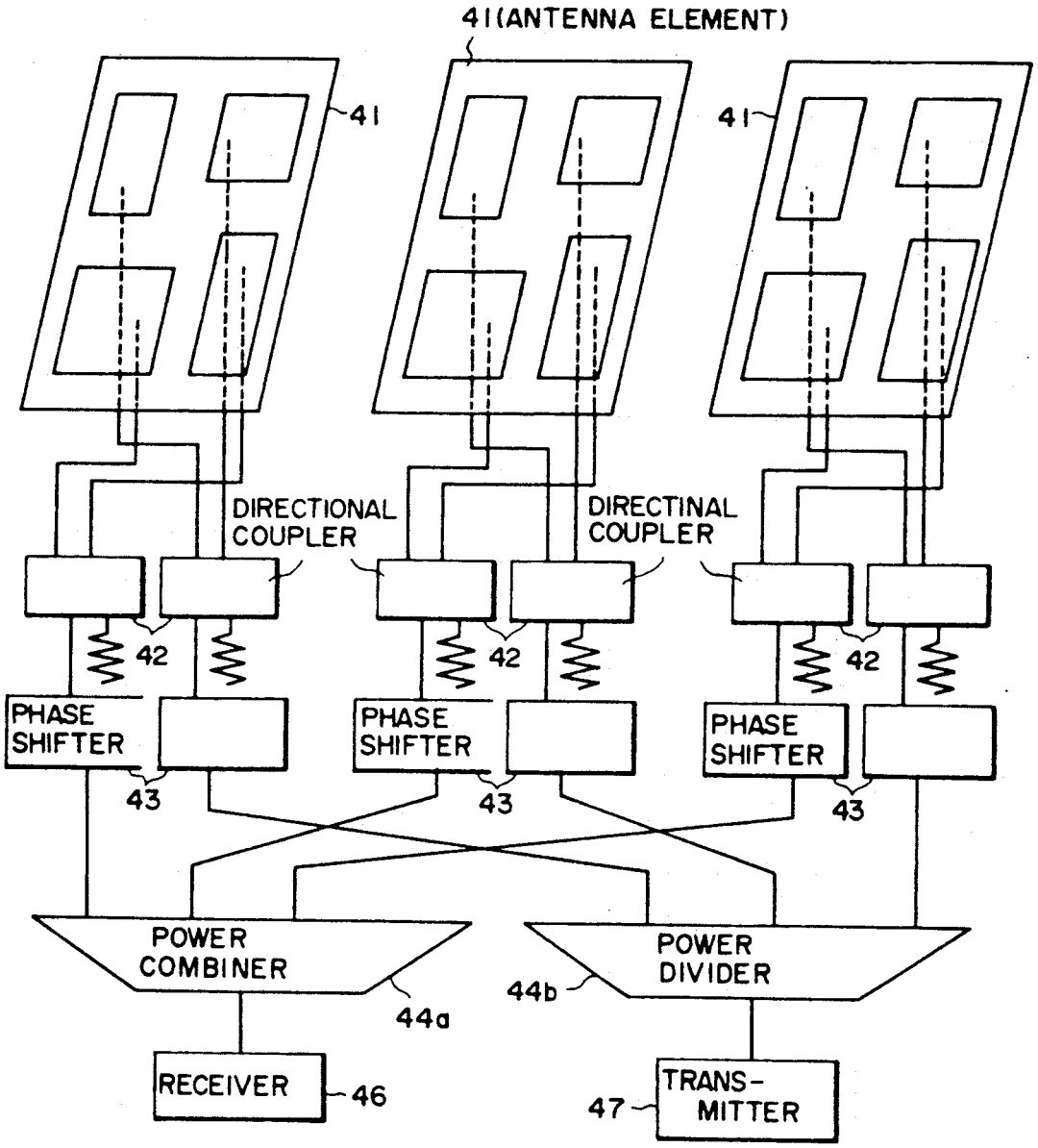
FIG. 4B is a block diagram illustrating a phased array antenna which is formed, as antenna elements, by the use of the microstrip antenna of two-frequency separate-feeding type for circularly polarized waves of the present invention shown in FIGS. 1, 2, 3A or 3B.

By limiting the sizes of the radiation conductors 111 through 114 to the bandwidths necessary for transmission and reception it is possible to prevent the coupling between transmission and reception from constituting an obstacle to communications. The feeding points 131 and 132 are each connected from the back side of the conducting ground plane 14 to a transmitter via a feeder and a directional coupler. Since the radiation conductors 111 and 112 generate linearly polarized waves perpendicularly intersecting each other, a transmitting circularly polarized wave can be generated by feeding from a directional coupler 421 through feeder 463 and 464 to feeding points as shown in FIG. 4A so that the phases of feeding are displaced 90° apart from each other. Whether the polarized wave is right-handed or left-handed is determined by the direction of connection of the directional coupler. For reception as well, a circularly polarized wave is received via radiation conductors 411 and 412, feeders 461 and 462 and a directional coupler 420 on the same principle as mentioned above to a receiver. A phased array antenna with a plurality of such antennas arrayed as shown in FIG. 4B has a wide-angle radiation characteristic, dispenses with the diplexer and the circulator, and is free from disagreement between transmission and reception beams. In this case, reference numeral 42 is a directional coupler, 43 a phase shifter 43. A transmitter 47 is connected to phase shifters 43 through a power divider **44*b*. For reception, the outputs of phase shifters are applied to a receiver 66 after combining by a power combiner 44*a***.

The one side-shorted microstrip antenna for use in the present invention has already been proposed (Haneishi, et al., "On Radiation Characteristics of One Side Shorted Microstrip Antenna," '83 National Convention of Institute of Electronics and Communication Engineers of Japan, Proceedings No. 3, pp 743, the Institute of Electronics and Communication Engineers of Japan, Mar. 5, 1983). In this antenna the radiation conductors used are as small as about one-half that an ordinary microstrip antennas, and consequently, the microstrip antenna of the present invention can be miniaturized.

EMBODIMENT 2

Figure 2:
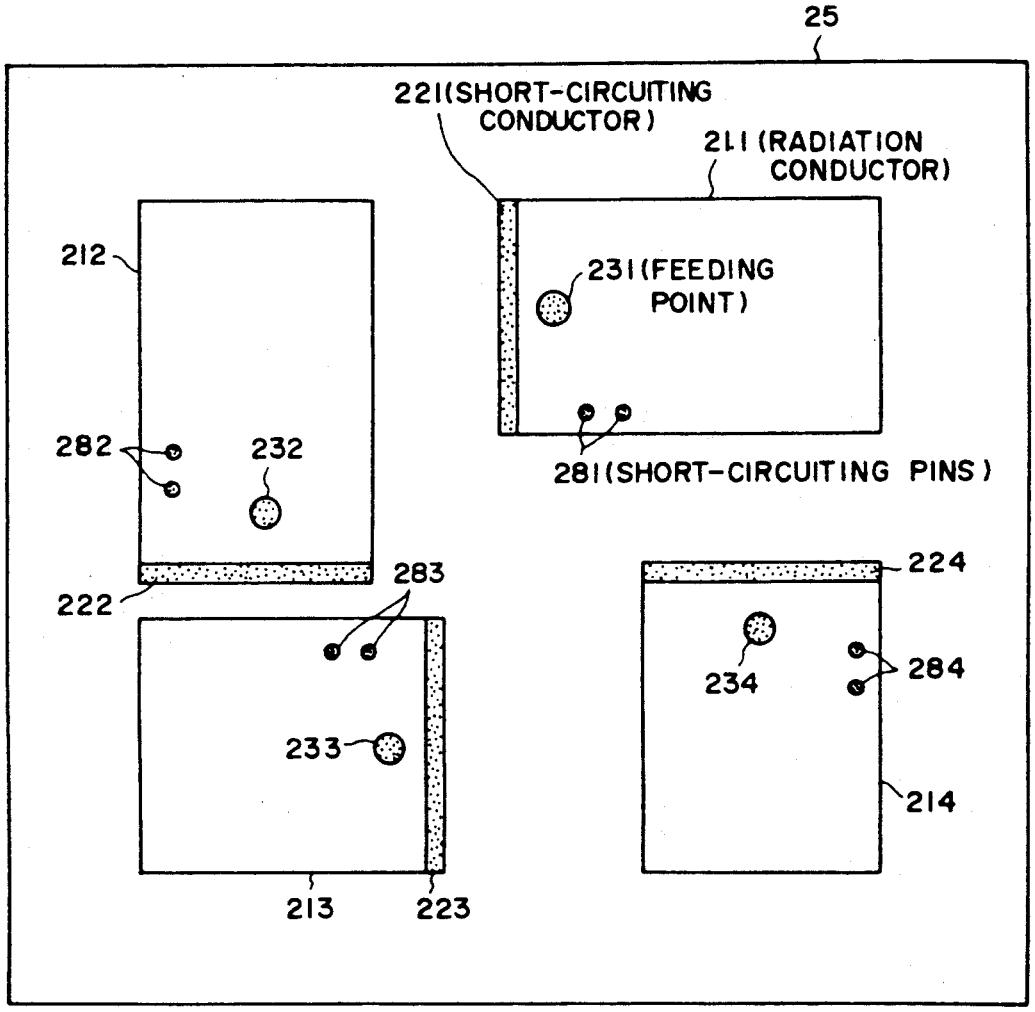
FIGS. 2, 3A and 3B are plan views illustrating other embodiments of the present invention.

FIG. 2 illustrates a second embodiment of the present invention, in which short-circuiting conductors 281 through 284 are provided between rectangular one side shorted microstrip radiation conductors 211 through 214 and a conducting ground plane (a plane 24 not shown but provided at the back side of the dielectric plane similarly to the conducting ground plane 14 in FIG. 1B), in addition to short-circuiting conductors 221 through 224. Reference numerals 231 through 234 are feeding points feeding through feeders not shown. The short-circuiting conductors 281 through 284 shown to be pin-type but may also be replaced by short-circuiting plates, solder, or electrolytic plating. With the short-circuiting pins, a microstrip antenna of excellent impedance matching can easily be implemented. When the influence of mutual coupling is present, the axial ratio may sometimes be degraded, but the provision of the short-circuiting pins permits correction of phase, and hence makes it possible to obtain a microstrip antenna of an excellent axial ratio.

EMBODIMENT 3

Figure 3A:
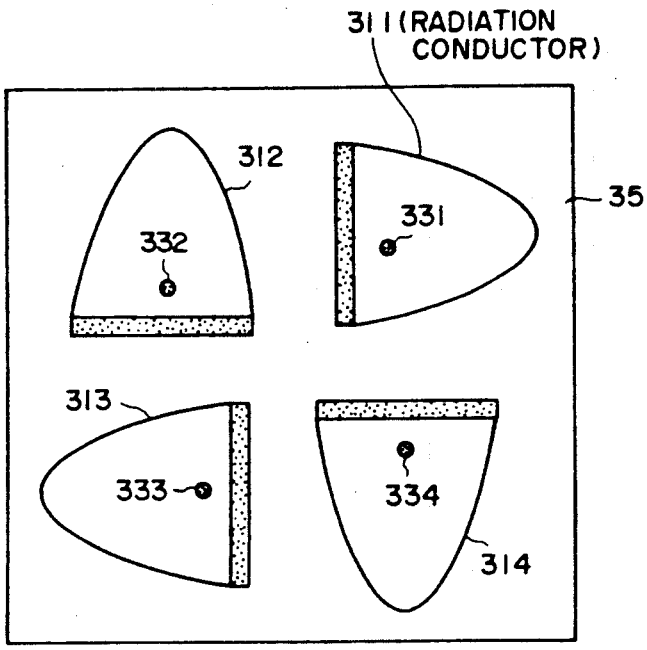

FIG. 3A illustrates another embodiment in which the radiation conductors 111 through 114 in Embodiment 1 are partly cut away to prepare radiation conductors 311 through 314. The present invention is applicable as well to such radiation conductors. In this case, reference numerals 331 to 334 are feeding points feeding from its back side by feeders not shown; and 35 a dielectric plate.

EMBODIMENT 4

Figure 3B:
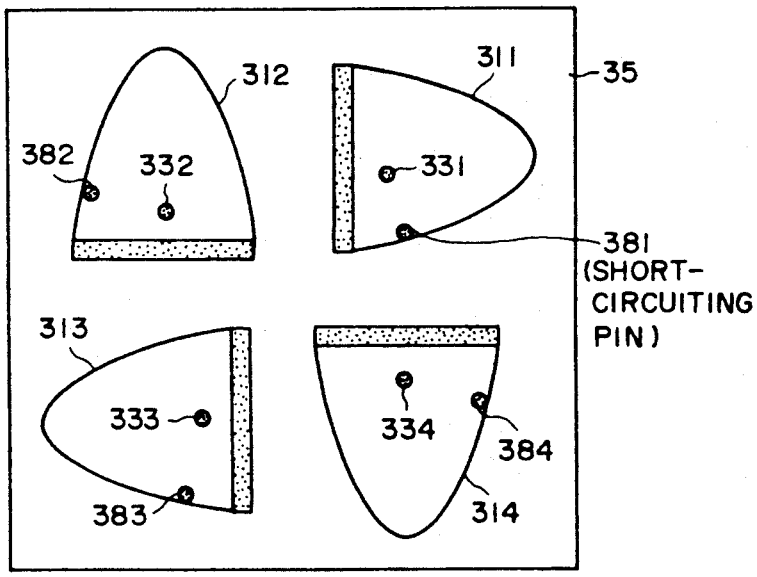

FIG. 3B illustrates another embodiment in which short-circuiting pins 381 through 384 are provided in Embodiment 3. The present invention is equally applicable to such a configuration.

As described above, according to the present invention, a small, lightweight and easy-to-manufacture microstrip antenna which is capable of simultaneously transmitting and receiving circularly polarized waves of two frequencies can be implemented by arranging two pairs of one side shorted microstrip antennas of different sizes, that is, a total of four microstrip antennas, on the same plane.

By employing such an antenna as one element of a phased array antenna, a small, two-frequency separate feeding type antenna for circularly polarized waves, which has a wide-angle radiation characteristic, can be implemented on the same plane.

Incidentally, if the short-circuiting sides of the microstrip antenna by electrolytic plating or the like, then the antenna of the present invention could easily be fabricated through use of a conventional printed-board manufacturing step.

What we claim is:

1. A microstrip antenna comprising, a dielectric substrate, four radiation conductors on a same plane on a first major surface of the substrate and a conductive ground plane on a second major surface of the substrate opposite to the first major surface thereof, each radiation conductor having a substantially straight side marginal edge portion short-circuiting conductor short-circuited to the conductive ground plane and each radiation conductor having a single feeding point, for each radiation conductor, a power feeder passing through said conductive ground plane and said substrate and connected to the respective single feeding point of a radiation conductor, the four radiation conductors being formed into two pairs of different dimensions and resonance frequencies and orthogonally arranged in each pair asymmetrically for respective two pairs, said radiation conductors having the same dimension and the same resonance frequency in each of said two pairs, said two pairs being independently fed, for each pair, to a transmitter and a receiver respectively, so that the antenna operates at two separate and desired frequencies for transmission and reception respectively in each pair of said four radiation conductors to generate polarized waves without coupling and interference between the transmission and reception frequencies.

2. A microstrip antenna according to claim 1, in which each of the four radiation conductors comprises other means for short-circuiting a portion of the corresponding radiation conductor to the conductive ground plane adjacent said marginal edge portion thereof.

3. A microstrip antenna according to claim 2, in which said other means comprises short-circuiting pins.

4. A microstrip antenna according to claim 2, in which said other means comprises holes in said radiation conductors extending through the radiation conductors and the conductive ground plane, and a conductive filler in said holes.

5. A microstrip antenna according to claim 4, in which conductive filler is solder.

6. A microstrip antenna according to claim 4, in which said conductive filler comprises an electroplating material.

7. A microstrip antenna according to claim 1, in which said feeding point of each said radiation conductor is spaced from said short-circuiting conductor of the corresponding radiation conductor, and a plane normal to said short-circuiting conductor passes through the feeding point of the corresponding radiation conductor.

* * * * *